US008575830B2

(12) United States Patent
Ma

(10) Patent No.: US 8,575,830 B2
(45) **Date of Patent: *Nov. 5, 2013**

(54) ELECTRODE MATERIAL FOR A SPARK PLUG

(75) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 32 days.

This patent is subject to a terminal disclaimer.

(21) Appl. No.: 13/355,891

(22) Filed: Jan. 23, 2012

(65) Prior Publication Data

US 2012/0194056 A1 Aug. 2, 2012

Related U.S. Application Data

(60) Provisional application No. 61/436,746, filed on Jan. 27, 2011.

(51) Int. Cl.

| | |
|---|---|
| ***H01T 13/02*** | (2006.01) |
| ***H01T 13/39*** | (2006.01) |
| ***H01J 9/02*** | (2006.01) |

(52) U.S. Cl.

USPC ..... 313/141; 419/28; 445/7; 445/46

(58) Field of Classification Search

None

See application file for complete search history.

(56) References Cited

U.S. PATENT DOCUMENTS

| | | | |
|---|---|---|---|
| 2,328,580 | A | 9/1943 | Pickus |
| 2,391,456 | A | 12/1945 | Hensel |
| 2,391,457 | A | 12/1945 | Carlson |
| 2,406,172 | A | 8/1946 | Smithells |
| 2,470,034 | A | 5/1949 | Hensel |
| 2,545,438 | A | 3/1951 | Stumbpck |
| 3,159,460 | A | 12/1964 | Hill |
| 3,278,280 | A | 10/1966 | Holtz |
| 3,362,799 | A | 1/1968 | Fletcher |
| 3,528,862 | A | 9/1970 | Jones et al. |
| 3,868,430 | A | 2/1975 | Giangaspero |
| 3,957,451 | A | 5/1976 | Rasmussen et al. |
| 3,977,841 | A | 8/1976 | Rasmussen et al. |

(Continued)

FOREIGN PATENT DOCUMENTS

| | | |
|---|---|---|
| DE | 10005559 | 8/2001 |
| GB | 556253 | 9/1943 |

(Continued)

OTHER PUBLICATIONS

International Search Report for PCT/US2010/058501, Aug. 31, 2011, 3 pages.

(Continued)

*Primary Examiner* — Ashok Patel

(74) *Attorney, Agent, or Firm* — Reising Ethington P.C.

(57) ABSTRACT

An electrode material that may be used in spark plugs and other ignition devices including industrial plugs, aviation igniters, glow plugs, or any other device that is used to ignite an air/fuel mixture in an engine. The electrode material is a metal composite and includes a particulate component embedded or dispersed within a matrix component such that the metal composite has a multi-phase microstructure. In one embodiment, the metal composite includes a matrix component that includes a precious metal and makes up about 2-80% wt of the overall composite and a particulate component that includes a ruthenium-based material and makes up about 20-98% wt of the overall composite.

20 Claims, 3 Drawing Sheets

(56) References Cited

U.S. PATENT DOCUMENTS

| | | | |
|---|---|---|---|
| 4,324,588 | A | 4/1982 | Zysk et al. |
| 4,427,915 | A | 1/1984 | Nishio et al. |
| 4,659,960 | A | 4/1987 | Toya |
| 4,692,657 | A | 9/1987 | Grunwald et al. |
| 4,743,793 | A | 5/1988 | Toya et al. |
| 4,771,209 | A | 9/1988 | Ryan |
| 4,786,267 | A | 11/1988 | Toya et al. |
| 4,881,913 | A | 11/1989 | Mann |
| 4,910,428 | A | 3/1990 | Strumbos |
| 4,939,409 | A | 7/1990 | Freise et al. |
| 5,101,135 | A | 3/1992 | Oshima |
| 5,347,193 | A | 9/1994 | Oshima |
| 5,448,130 | A | 9/1995 | Matsutani et al. |
| 5,456,624 | A | 10/1995 | Moore |
| 5,461,275 | A | 10/1995 | Oshima |
| 5,514,929 | A | 5/1996 | Kawamura |
| 5,550,425 | A | 8/1996 | Yoder |
| 5,578,895 | A | 11/1996 | Oshima |
| 5,675,209 | A | 10/1997 | Hall, Jr. |
| 5,793,793 | A | 8/1998 | Matsutani et al. |
| 5,796,019 | A | 8/1998 | Lupton |
| 5,866,973 | A | 2/1999 | Kagawa et al. |
| 5,869,921 | A | 2/1999 | Matsutani |
| 5,890,272 | A | 4/1999 | Liberman |
| 5,894,186 | A | 4/1999 | Matsutani et al. |
| 5,898,257 | A | 4/1999 | Sequerra et al. |
| 5,990,602 | A | 11/1999 | Katoh et al. |
| 5,997,695 | A | 12/1999 | Ilmarinen |
| 5,998,913 | A | 12/1999 | Matsutani et al. |
| 6,045,424 | A | 4/2000 | Chang et al. |
| 6,046,532 | A | 4/2000 | Matasutani et al. |
| 6,071,163 | A | 6/2000 | Chang et al. |
| 6,094,000 | A | 7/2000 | Osamura et al. |
| 6,095,124 | A | 8/2000 | Matsubara et al. |
| 6,121,719 | A | 9/2000 | Matsutani et al. |
| 6,166,479 | A | 12/2000 | Matasutani et al. |
| 6,262,522 | B1 | 7/2001 | Osamura et al. |
| 6,304,022 | B1 | 10/2001 | Matsutani |
| 6,326,719 | B1 | 12/2001 | Boehler |
| 6,407,487 | B1 | 6/2002 | Sugimoto |
| 6,412,465 | B1 | 7/2002 | Lykowski |
| 6,523,515 | B2 | 2/2003 | Kanao |
| 6,533,628 | B1 | 3/2003 | Matsutani et al. |
| 6,579,738 | B2 | 6/2003 | Farrar |
| 6,611,083 | B2 | 8/2003 | LaBarge et al. |
| 6,628,051 | B1 | 9/2003 | Menken |
| 6,664,719 | B2 | 12/2003 | Matsutani et al. |
| 6,750,597 | B1 | 6/2004 | Sakura |
| 6,790,113 | B1 | 9/2004 | Fujita |
| 6,794,803 | B2 | 9/2004 | Hori et al. |
| 6,798,125 | B2 | 9/2004 | Sugiyama et al. |
| 6,864,622 | B2 | 3/2005 | Matsutani et al. |
| 6,869,328 | B2 | 3/2005 | Ulm et al. |
| 7,084,558 | B2 | 8/2006 | Teramura et al. |
| 7,131,191 | B2 | 11/2006 | Matsutani et al. |
| 7,132,782 | B2 | 11/2006 | Kato et al. |
| 7,150,252 | B2 | 12/2006 | Sugiyama et al. |
| 7,164,225 | B2 | 1/2007 | Yoshimoto et al. |
| 7,221,078 | B2 | 5/2007 | Watanabe |
| 7,279,827 | B2 | 10/2007 | Nunome et al. |
| 7,288,879 | B2 | 10/2007 | Matsutani et al. |
| 7,321,187 | B2 | 1/2008 | Teramura et al. |
| 7,336,024 | B2 | 2/2008 | Yoshimoto et al. |
| 7,382,084 | B2 | 6/2008 | Yoshimoto et al. |
| 7,385,339 | B2 | 6/2008 | Lineton et al. |
| 7,449,823 | B2 | 11/2008 | Menken et al. |
| 7,569,979 | B2 | 8/2009 | Lykowski et al. |
| 7,637,793 | B2 | 12/2009 | Lintunen et al. |
| 7,815,849 | B2 | 10/2010 | Koch et al. |
| 8,274,203 | B2 * | 9/2012 | Ma et al. ..... 313/141 |
| 2003/0178925 | A1 | 9/2003 | Kumagai |
| 2004/0140745 | A1 | 7/2004 | Hrastnik |
| 2005/0168121 | A1 | 8/2005 | Tinwell |
| 2005/0179353 | A1 | 8/2005 | Watanabe |
| 2006/0158082 | A1 | 7/2006 | Menken |
| 2007/0057613 | A1 | 3/2007 | Brady |
| 2007/0190364 | A1 | 8/2007 | Das |
| 2007/0236123 | A1 | 10/2007 | Lykowski |
| 2007/0236124 | A1 | 10/2007 | Lykowski |
| 2007/0278924 | A1 | 12/2007 | Aisenbrey |
| 2008/0074025 | A1 | 3/2008 | Hori |
| 2008/0206601 | A1 | 8/2008 | Mukai |
| 2008/0308057 | A1 | 12/2008 | Lykoski |
| 2009/0284117 | A1 | 11/2009 | Lykowski |
| 2010/0045156 | A1 | 2/2010 | Menken et al. |
| 2010/0052497 | A1 | 3/2010 | Walker, Jr. |
| 2010/0264802 | A1 * | 10/2010 | Tanaka et al. ..... 313/141 |
| 2011/0127900 | A1 * | 6/2011 | Ma et al. ..... 313/141 |
| 2011/0198983 | A1 | 8/2011 | Manhardt |
| 2012/0025690 | A1 | 2/2012 | Kohl |
| 2012/0025692 | A1 | 2/2012 | Ma |
| 2012/0169206 | A1 * | 7/2012 | Ma ..... 313/141 |
| 2012/0212119 | A1 * | 8/2012 | Ma ..... 313/141 |
| 2013/0002121 | A1 * | 1/2013 | Ma ..... 313/141 |

FOREIGN PATENT DOCUMENTS

| | | |
|---|---|---|
| GB | 575998 | 3/1946 |
| GB | 717496 | 10/1954 |
| GB | 755835 | 8/1956 |
| GB | 830628 | 3/1960 |
| JP | 2207476 | 8/1990 |
| JP | 7268574 | 10/1995 |
| JP | 8339880 | 12/1996 |
| JP | 2000331770 | 11/2000 |
| JP | 2002346625 | 12/2002 |
| JP | 2003053419 | 2/2003 |
| JP | 2004031300 | 1/2004 |
| JP | 3902756 | 5/2004 |
| JP | 2004235040 | 8/2004 |
| JP | 2008053017 | 3/2008 |
| JP | 2008053018 | 3/2008 |
| KR | 20020050486 | 6/2002 |

OTHER PUBLICATIONS

Written Opinion & International Search Report for PCT/US11/45767, Mar. 20, 2012, 11 pages.

Written Opinion & International Search Report for PCT/US12/022184, Sep. 14, 2012, 13 pages.

* cited by examiner

ELECTRODE MATERIAL FOR A SPARK PLUG

REFERENCE TO RELATED APPLICATIONS

This application claims the benefit of U.S. Provisional Ser. No. 61/436,746 filed on Jan. 27, 2011, the entire contents of which are incorporated herein.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, there is provided a spark plug that comprises: a metallic shell that has an axial bore; an insulator that has an axial bore and is at least partially disposed within the axial bore of the metallic shell; a center electrode that is at least partially disposed within the axial bore of the insulator; and a ground electrode that is attached to a free end of the metallic shell. The center electrode, the ground electrode or both includes an electrode material that has a particulate component embedded within a matrix component in the form of a metal composite. The particulate component includes a ruthenium-based material that has at least one precious metal, where ruthenium (Ru) is the single largest constituent of the particulate component on a wt % basis. The matrix component includes a precious metal, where the precious metal is the single largest constituent of the matrix component on a wt % basis.

According to another embodiment, there is provided a spark plug electrode that comprises: an electrode material that has a particulate component embedded within a matrix component in the form of a metal composite. The particulate component includes a ruthenium-based material, where ruthenium (Ru) is the single largest constituent of the particulate component on a wt % basis. The matrix component includes a precious metal, where the precious metal is the single largest constituent of the matrix component on a wt % basis.

According to yet another embodiment, there is provided a method of forming a spark plug electrode. The method may comprise the steps of: (a) providing a matrix component and a particulate component in powder form, wherein the matrix component includes at least one precious metal and the particulate component includes ruthenium (Ru); (b) blending the matrix component and particulate component powders together to form a powder mixture; (c) sintering the powder mixture to form an electrode material, where the electrode material is in the form of a metal composite with the particulate component embedded or dispersed in the matrix component; and (d) forming the electrode material into a spark plug electrode.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
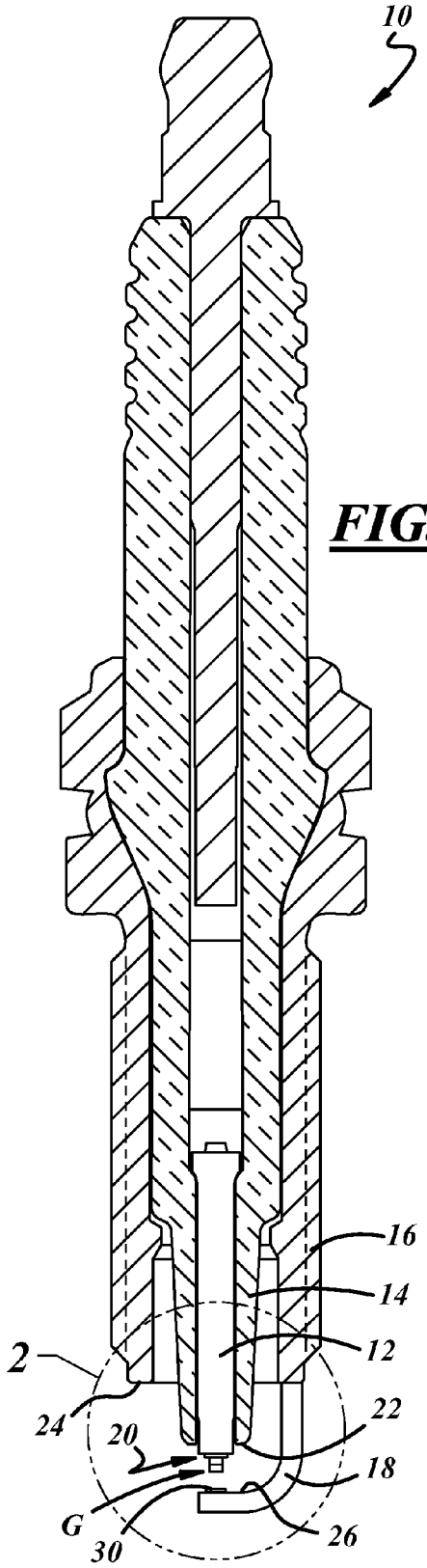
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible.

Figure 2:
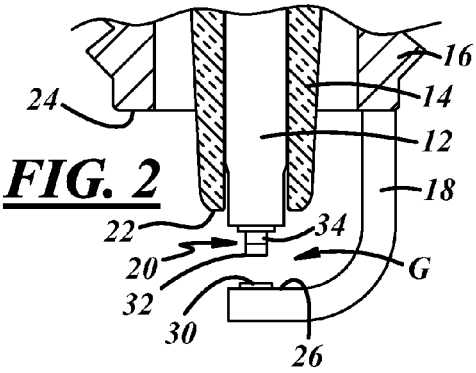
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
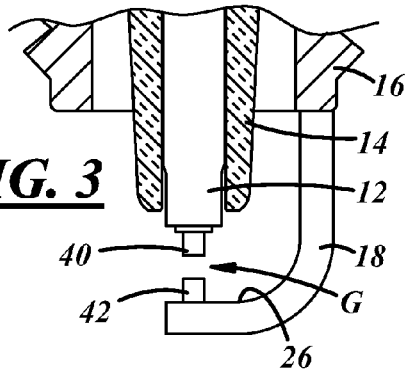
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
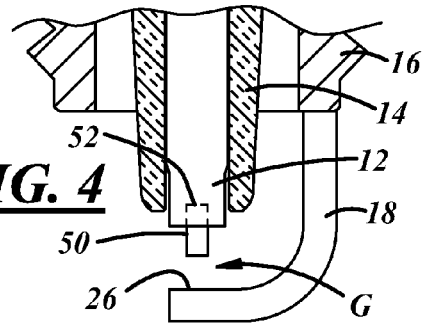
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
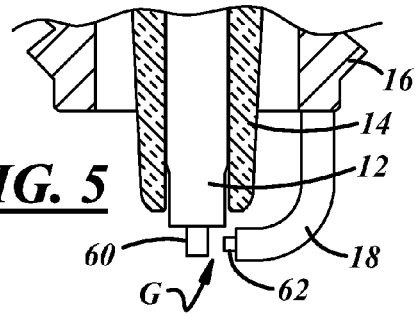
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

Figure 6:
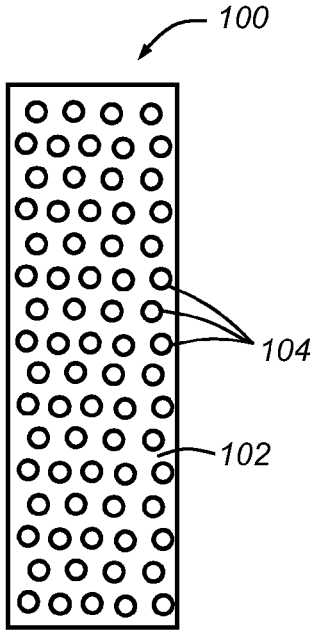
FIG. 6 is a cross-sectional view of an exemplary electrode material, where the electrode material is in the form of a composite material and includes a matrix component and a particulate component.

With reference to the exemplary embodiment illustrated in FIG. 6, the electrode material is a metal composite 100 and includes a particulate component 104 embedded or dispersed within a matrix component 102. Accordingly, metal composite 100 has a multi-phase microstructure where, on a macroscale, the matrix component 102 differs in composition and/or form from the particulate component 104. The individual components or phases of the exemplary metal composite 100 do not completely dissolve or merge into one another, even though they may interact with one another, and therefore may exhibit a boundary or junction between them. According to one non-limiting example, metal composite 100 includes a matrix component 102 that makes up about 2-20% wt of the overall composite and a particulate component 104 that makes up about 80-98% wt of the overall composite, where the matrix component includes pure platinum and the particulate component includes a ruthenium-based alloy of Ru-5Rh. Other compositions are certainly possible, as explained below.

Matrix component 102—also referred to as a matrix phase or binder—is the portion of the electrode material into which the particulate component 104 is embedded or dispersed. Matrix component 102 may include one or more precious metals, such as platinum (Pt), palladium (Pd), gold (Au) and/or silver (Ag), but according to an exemplary embodiment it includes a platinum-based material. The term "platinum-based material," as used herein, broadly includes any material where platinum (Pt) is the single largest constituent on a weight % basis. This may include materials having greater than 50% platinum, as well as those having less than 50% platinum, so long as the platinum is the single largest constituent. It is possible for matrix component 102 to include a pure precious metal (e.g., pure platinum (Pt) or pure palladium (Pd)), a binary-, ternary- or quaternary-alloy including one or more precious metals, or some other suitable material. According to an exemplary embodiment, matrix component 102 makes up about 2-80 wt % of the overall metal composite 100 and includes a pure platinum (Pt) material with grains that have a grain size that ranges from about 1 μm to 20 μm, inclusive (i.e., after the electrode material has been extruded). The size of the grains can be determined by using a suitable measurement method, such as the Planimetric method outlined in ASTM E112. This is, of course, only one possibility for the matrix component, as other embodiments are certainly possible. For example, the matrix material may include one or more precious metals, refractory metals and/or rare earth metals, each of which may be selected to impart certain properties or attributes to the electrode material. A periodic table published by the International Union of Pure and Applied Chemistry (IUPAC) is provided in Addendum A (hereafter the "attached periodic table") and is to be used with the present application.

Particulate component 104—also referred to as a particulate phase or reinforcement—is the portion of the electrode material that is embedded or dispersed in the matrix component 102. Particulate component 104 may include a ruthenium-based material that includes one or more precious metals, like rhodium (Rh), platinum (Pt), iridium (Ir), or combinations thereof. The term "ruthenium-based material," as used herein, broadly includes any material where ruthenium (Ru) is the single largest constituent on a weight % basis. This may include materials having greater than 50% ruthenium, as well as those having less than 50% ruthenium, so long as the ruthenium is the single largest constituent. Skilled artisans will appreciate that ruthenium has a rather high melting temperature (2334° C.) compared to some precious metals, which can improve the erosion resistance of the electrode material. However, ruthenium can be more susceptible to oxidation than some precious metals, which can lower the corrosion resistance of the electrode material. Thus, the particulate component 104 disclosed herein may include ruthenium plus one or more additional constituents like precious metals, refractory metals and/or rare earth metals, each of which is selected to impart certain properties or attributes to the electrode material. According to an exemplary embodiment, particulate component 104 makes up about 20-98 wt % of the overall metal composite 100, it is a hard and brittle particulate that includes a ruthenium-based material having rhodium (Rh), platinum (Pt), iridium (Ir) or combinations thereof (i.e, a Ru—Rh, Ru—Pt, Ru—Ir, Ru—Rh—Pt, Ru—Rh—Ir, Ru—Pt—Rh, Ru—Pt—Ir, Ru—Ir—Rh or a Ru—Ir—Pt alloy), and it has grains that range in size from about 1 μm to 20 μm, inclusive, after extrusion. One exemplary ruthenium-based material composition that may be particularly useful is Ru—Rh, where the rhodium (Rh) is from about 0.1 to 15 wt % and the ruthenium (Ru) constitutes the balance. This is, of course, only one possibility for the particulate component, as other embodiments are certainly possible. It is also possible for particulate component 104 to include one or more refractory metals and/or rare earth metals, or for the particulate material to be made of pure ruthenium (Ru).

The precious metal may provide the electrode material with a variety of desirable attributes, including a high resistance to oxidation and/or corrosion. Some non-limiting examples of precious metals that are suitable for use in matrix component 102 include platinum (Pt), palladium (Pd), gold (Au) and/or silver (Ag), while non-limiting examples of suitable precious metals for particulate component 104 include rhodium (Rh), platinum (Pt), palladium (Pd), iridium (Ir) and/or gold (Au). In an exemplary embodiment of matrix component 102, the matrix component includes a pure precious metal, such as pure platinum (Pt) or pure palladium (Pd). In an exemplary embodiment of particulate component 104, a precious metal is the second greatest or largest constituent of the particulate component on a wt % basis, after ruthenium (Ru), and is present in the particulate component from about 0.1 wt % to about 49.9 wt %, inclusive. Some examples of such a particulate material include binary allows such as Ru—Rh, Ru—Pt, and Ru—Ir. It is also possible for particulate component 104 to include more than one precious metal and, in at least one embodiment, the particulate component includes ruthenium (Ru) plus first and second precious metals. Each of the first and second precious metals may be present in particulate component 104 from about 0.1 wt % to about 49.9 wt %, inclusive, and the combined amount of the first and second precious metals together is equal to or less than about 65 wt %, inclusive. Some examples of such a particulate material include the following ternary and quaternary alloys: Ru—Rh—Pt, Ru—Pt—Rh, Ru—Rh—Ir, Ru—Pt—Ir, Ru—Rh—Pd, Ru—Pt—Pd, Ru—Rh—Au, Ru—Pt—Au, Ru—Rh—Pt—Ir, Ru—Rh—Pt—Pd and Ru—Rh—Pt—Au alloys. In each of these embodiments, ruthenium (Ru) is still preferably the largest single constituent. One or more additional elements, compounds and/or other constituents may be added to the matrix and/or particulate materials described above, including refractory metals and/or rare earth metals.

The refractory metal may provide the electrode material with any number of desirable attributes, including a high melting temperature and correspondingly high resistance to spark erosion, as well as improved ductility during manufacturing. Some non-limiting examples of refractory metals that are suitable for use in the electrode material include tungsten (W), rhenium (Re), tantalum (Ta), molybdenum (Mo) and niobium (Nb); nickel (Ni) may be added to the electrode material as well. In an exemplary embodiment, a refractory metal is a constituent of the particulate component and may join ruthenium (Ru) and one or more precious metals, and is present in particulate component 104 from about 0.1 wt % to about 10 wt %, inclusive. The refractory and precious metals may cooperate with the ruthenium (Ru) in the particulate material such that the electrode has a high wear resistance, including significant resistance to spark erosion, chemical corrosion, and/or oxidation, for example. The relatively high melting points of the refractory metals and the ruthenium may provide the electrode material with a high resistance to spark erosion or wear, while the precious metals may provide the electrode material with a high resistance to chemical corrosion and/or oxidation. A table listing some exemplary precious and refractory metals, as well as their corresponding melting temperatures, is provided below (TABLE I).

TABLE I

Melting Temperatures of Exemplary Metals

| | Melting Temperature (° C.) |
|---|---|
| Precious Metals | |
| Rhodium (Rh) | 1964 |
| Platinum (Pt) | 1768 |
| Palladium (Pd) | 1555 |
| Iridium (Ir) | 2446 |
| Gold (Au) | 1064 |
| Silver (Ag) | 961 |
| Refractory Metals | |
| Tungsten (W) | 3422 |
| Molybdenum (Mo) | 2623 |
| Niobium (Nb) | 2468 |
| Tantalum (Ta) | 2996 |
| Rhenium (Re) | 3186 |

The rare earth metal may provide the electrode material with any number of desirable attributes, including improved resistance to erosion and/or corrosion. Some non-limiting examples of rare earth metals that are suitable for use in the electrode material include yttrium (Y), hafnium (Hf), scandium (Sc), zirconium (Zr) and lanthanum (La). In an exemplary embodiment, a rare earth metal is a constituent of the particulate component along with ruthenium (Ru), one or more precious metals, and one or more refractory metals, and is present in particulate component 104 from about 0.01 wt % to 0.1 wt %, inclusive. The rare earth metals may form a protective oxide layer (e.g., $Y_2O_3$, $ZrO_2$, etc.) in the electrode material that is beneficial in terms of material performance.

In an exemplary embodiment of the matrix component 102, the matrix component includes pure platinum (Pt), pure palladium (Pd) or some other pure precious metal. In another embodiment, the matrix component 102 includes a platinum-based material that has platinum (Pt) from about 50 wt % to about 99.9 wt %, inclusive, and another precious metal, a refractory metal or a rare earth metal from about 0.1 wt % to about 49.9 wt %, inclusive, where the platinum (Pt) is the single largest constituent of the matrix material on a wt % basis.

In an exemplary embodiment of the particulate component 104, the particulate component includes a ruthenium-based material with ruthenium (Ru) from about 50 wt % to about 99.9 wt %, inclusive, and a single precious metal from about 0.1 wt % to about 49.9 wt %, inclusive, where the ruthenium (Ru) is the single largest constituent of the particulate material on a wt % basis. Rhodium (Rh), platinum (Pt) or iridium (Ir), for example, may be the precious metal referred to above. Examples of suitable particulate material compositions that fall within this exemplary embodiment include those compositions having ruthenium (Ru) plus one precious metal selected from the group of rhodium (Rh), platinum (Pt) or iridium (Ir), such as Ru—Rh, Ru—Pt or Ru—Ir. Such compositions may include the following non-limiting examples: Ru-45Rh, Ru-40Rh, Ru-35Rh, Ru-30Rh, Ru-25Rh, Ru-20Rh, Ru-15Rh, Ru-10Rh, Ru-5Rh, Ru-2Rh, Ru-1Rh, Ru-0.5Rh, Ru-0.1Rh, Ru-45Pt, Ru-40Pt, Ru-35Pt, Ru-30Pt, Ru-25Pt, Ru-20Pt, Ru-15Pt, Ru-10Pt, Ru-5Pt, Ru-2Pt, Ru-0.1Pt, Ru-0.5Pt, Ru-0.1Pt, Ru-45Ir, Ru-40Ir, Ru-35Ir, Ru-30Ir, Ru-25Ir, Ru-20Ir, Ru-15Ir, Ru-10Ir, Ru-5Ir, Ru-2Ir, Ru-0.1Ir, Ru-0.5Ir, Ru-0.1Ir, other examples are certainly possible. The following particulate compositions may be used in a metal composite where about 20 wt % of the metal composite is a Pt matrix: Ru-5Rh; Ru-2Rh; Ru-1Re and pure Ru. The following particulate compositions may be used in a metal composite where about 10 wt % of the metal composite is a Pt matrix: Ru-5Rh; Ru-2Rh; Ru-1Re and pure Ru. The following particulate compositions may be used in a metal composite where about 5 wt % of the metal composite is a Pt matrix: Ru-5Rh; Ru-2Rh; Ru-2Rh; Ru-1Re and pure Ru. In one specific embodiment, the particulate component 104 includes a ruthenium-based material that includes ruthenium (Ru) from about 85 wt % to about 99.9 wt %, inclusive, and rhodium (Rh) from about 0.1 wt % to about 15 wt %.

In another embodiment of the particulate component 104, the particulate component includes a ruthenium-based material with ruthenium (Ru) from about 35 wt % to about 99.9 wt %, inclusive, a first precious metal from about 0.1 wt % to about 49.9 wt %, inclusive, and a second precious metal from about 0.1 wt % to about 49.9 wt %, inclusive, where the ruthenium (Ru) is the single largest constituent of the particulate material. Ruthenium-based materials that include rhodium (Rh) and platinum (Pt), where the combined amount of rhodium (Rh) and platinum (Pt) is between 1%-65%, inclusive, may be particularly useful for certain spark plug applications. Examples of suitable particulate material compositions that fall within this exemplary category include those compositions having ruthenium (Ru) plus two or more precious metals selected from the group of rhodium (Rh), platinum (Pt), palladium (Pd), iridium (Ir) and/or gold (Au), such as Ru—Rh—Pt, Ru—Rh—Pd, Ru—Rh—Ir, Ru—Rh—Au, Ru—Pt—Rh, Ru—Pt—Pd, Ru—Pt—Ir, Ru—Pt—Au, Ru—Pd—Rh, Ru—Pd—Pt, Ru—Pd—Ir, Ru—Pd—Au, Ru—Ir—Rh, Ru—Ir—Pt, Ru—Ir—Pd, Ru—Ir—Au, Ru—Au—Rh, Ru—Au—Pt, Ru—Au—Pd, Ru—Au—Ir, Ru—Rh—Pt—Ir, Ru—Rh—Pt—Pd, Ru—Rh—Pt—Au, Ru—Pt—Rh—Ir, Ru—Pt—Rh—Pd, Ru—Pt—Rh—Au, etc. Such compositions may include the following non-limiting examples: Ru-30Rh-30Pt, Ru-35Rh-25Pt, Ru-35Pt-25Rh, Ru-25Rh-25Pt; Ru-30Rh-20Pt, Ru-30Pt-20Rh, Ru-20Rh-20Pt, Ru-25Rh-15Pt, Ru-25Pt-15Rh, Ru-15Rh-15Pt, Ru-20Rh-10Pt, Ru-20Pt-10Rh, Ru-10Rh-10Pt, Ru-15Rh-5Pt, Ru-15Pt-5Rh, Ru-5Rh-5Pt, Ru-10Rh-1Pt, Ru-10Pt-1Rh, Ru-2Rh-2Pt, Ru-1Rh-1Pt, Ru-30Rh-20Ir, Ru-30Pt-20Ir, Ru-30Ir-20Rh, Ru-30Ir-20Pt, Ru-40Rh-10Pt, Ru-40Rh-10Ir, Ru-40Pt-10Rh, Ru-40Pt-10Ir, Ru-40Ir-10Rh, and Ru-40Ir-10Pt; other examples are certainly possible. The following particulate compositions may be used in a metal composite where about 20 wt % of the metal composite is a Pt matrix: Ru-5Rh-1Re and Ru-2Rh-1Re. The following particulate compositions may be used in a metal composite where about 10 wt % of the metal composite is a Pt matrix: Ru-5Rh-1Re; Ru-2Rh-1Re; Ru-5Rh-1Ir-1R and Ru-5Rh-1W-1R. The following particulate compositions may be used in a metal composite where about 5 wt % of the metal composite is a Pt matrix: Ru-5Rh-1Ir-1Re; Ru-5Rh-1W-1Re; Ru-5Rh-1Re and Ru-2Rh-1Re.

According to another exemplary embodiment of the particulate component 104, the particulate component includes a ruthenium-based material that includes ruthenium (Ru) from about 35 wt % to about 99.9 wt %, inclusive, one or more precious metals from about 0.1 wt % to about 49.9 wt %, inclusive, and a refractory metal from about 0.1 wt % to about 10 wt %, inclusive, where the ruthenium (Ru) is the single largest constituent of the electrode material. Tungsten (W), rhenium (Re), tantalum (Ta), molybdenum (Mo) and/or niobium (Nb), for example, may be a suitable refractory metal for the particulate material. Refractory metals may be used to strengthen the electrode material in one or more ways or to lower the overall cost, for instance. In one embodiment, a refractory metal constitutes the greatest constituent in the particulate component 104 after ruthenium (Ru) and one or more precious metals, and is present in an amount that is greater than or equal to 0.1 wt % and is less than or equal to 10 wt %. Examples of suitable particulate material compositions that fall within this exemplary embodiment include Ru—Rh—W, Ru—Rh—Mo, Ru—Rh—Nb, Ru—Rh—Ta, Ru—Rh—Re, Ru—Pt—W, Ru—Pt—Mo, Ru—Pt—Nb, Ru—Pt—Ta, Ru—Pt—Re, Ru—Rh—Pt—W, Ru—Rh—Pt—Mo, Ru—Rh—Pt—Nb, Ru—Rh—Pt—Ta, Ru—Rh—Pt—Re, Ru—Pt—Rh—W, Ru—Pt—Rh—Mo, Ru—Pt—Rh—Nb, Ru—Pt—Rh—Ta, Ru—Pt—Rh—Re, etc. Numerous compositional combinations of this embodiment are possible. Moreover, nickel (Ni) and/or a rare earth metal may be used in addition to or in lieu of the exemplary refractory metals listed above. Examples of a particulate material composition including nickel (Ni) include Ru—Rh—Ni, Ru—Pt—Ni, Ru—Rh—Pt—Ni, Ru—Pt—Rh—Ni, etc. The following particulate compositions may be used in a metal composite where about 20 wt % of the metal composite is a Pt matrix: Ru-5Rh-1Ir-1Re and Ru-5Rh-1W-1Re.

Depending on the particular properties that are desired, the amount of ruthenium (Ru) in the ruthenium-based material of the particulate component 104 may be: greater than or equal to 35 wt %, 50 wt %, 65 wt % or 80 wt %; less than or equal to 99.9%, 95 wt %, 90 wt % or 85 wt %; or between 35-99.9%, 50-99.9 wt %, 65-99.9 wt % or 80-99.9 wt %, to cite a few examples. Likewise, the amount of rhodium (Rh) and/or platinum (Pt) in the ruthenium-based material of the particulate component 104 may be: greater than or equal to 0.1 wt %, 2 wt %, 10 wt % or 20 wt %; less than or equal to 49.9 wt %, 40 wt %, 20 wt % or 10 wt %; or between 0.1-49.9 wt %, 0.1-40 wt %, 0.1-20 wt % or 0.1-10 wt %. The amount of rhodium (Rh) and platinum (Pt) combined or together in the ruthenium-based material of the particulate component 104 may be: greater than or equal to 1 wt %, 5 wt %, 10 wt % or 20 wt %; less than or equal to 65 wt %, 50 wt %, 35 wt % or 20 wt %; or between 1-65 wt %, 1-50 wt %, 1-35 wt % or 1-20 wt %. The amount of a refractory metal—i.e., a refractory metal other than ruthenium (Ru)—in the ruthenium-based material of the particulate component 104 may be: greater than or equal to 0.1 wt %, 1 wt %, 2 wt % or 5 wt %; less than or equal to 10 wt %, 8 wt % or 5 wt %; or between 0.1-10 wt %, 0.1-8 wt % or 0.1-5 wt %. The same exemplary percentage ranges apply to nickel (Ni). The amount of a rare earth metal in the ruthenium-based material of the particulate component 104 may be: greater than or equal to 0.01 wt % or 0.05 wt %; less than or equal to 0.1 wt % or 0.08 wt %; or between 0.01-0.1 wt %. The preceding amounts, percentages, limits, ranges, etc. are only provided as examples of some of the different material compositions that are possible, and are not meant to limit the scope of the electrode material, the particulate component and/or the matrix component.

It should be appreciated that the preceding material examples represent only some of the possible compositions. For example, other precious metal-based materials may be used for the matrix component 102, and other ruthenium-based materials may be used for the particulate component. As mentioned above, about 2-80 wt % or even more preferably 2-20 wt % of the metal composite 100 may be in the form of the matrix component 102, and about 20-98 wt % or even more preferably 80-98 wt % of the metal composite 100 may be in the form of the particulate component 104. Depending on the exact composition, metal composite 100 may have an average particulate component spacing of about 1-20 μm, inclusive; stated differently, the average distance between particulates or the average particle-to-particle spacing in the matrix may be about 1-20 μm, inclusive. It is also possible for metal composite 100 to have an average density that is less than or equal to 14.0 g/cm$^3$ when the matrix component makes up about 2-20 wt % and the particulate component makes up about 80-98 wt % of the overall metal composite, and for metal composite 100 to have an average density that is less than or equal to 16.8 g/cm$^3$ when the matrix component makes up about 50 wt % and the particulate component makes up about 50 wt % of the overall metal composite. The density of particulate component 104 is preferably less than that of matrix component 102, which can lower cost and significantly reduce the price of the material.

The overall composition of the metal composite 100, the proportion of matrix versus particulate components, the inter-particle spacing between particles of the particulate component 104 in the matrix component 102, and density characteristics of the metal composite 100 can provide the electrode material with certain performance and/or cost characteristics. For instance, with the above-listed characteristics it may be possible to provide an electrode material that is reasonably ductile so that it can be formed into different spark plug components, yet exhibit sufficient erosion and/or corrosion resistance. A low density can also make the electrode material quite cost efficient when it is priced by weight or mass. Once metal composite 100 has been extruded or subjected to a similar process, the microstructure of the composite may be altered such that the grains of the matrix component 102 are more elongated or more fiber-like than those of the particulate component 104. In some of the preceding exemplary systems, rhenium (Re) may be added to improve the overall ductility of the electrode material so that it can be more easily manufactured.

Figure 7:
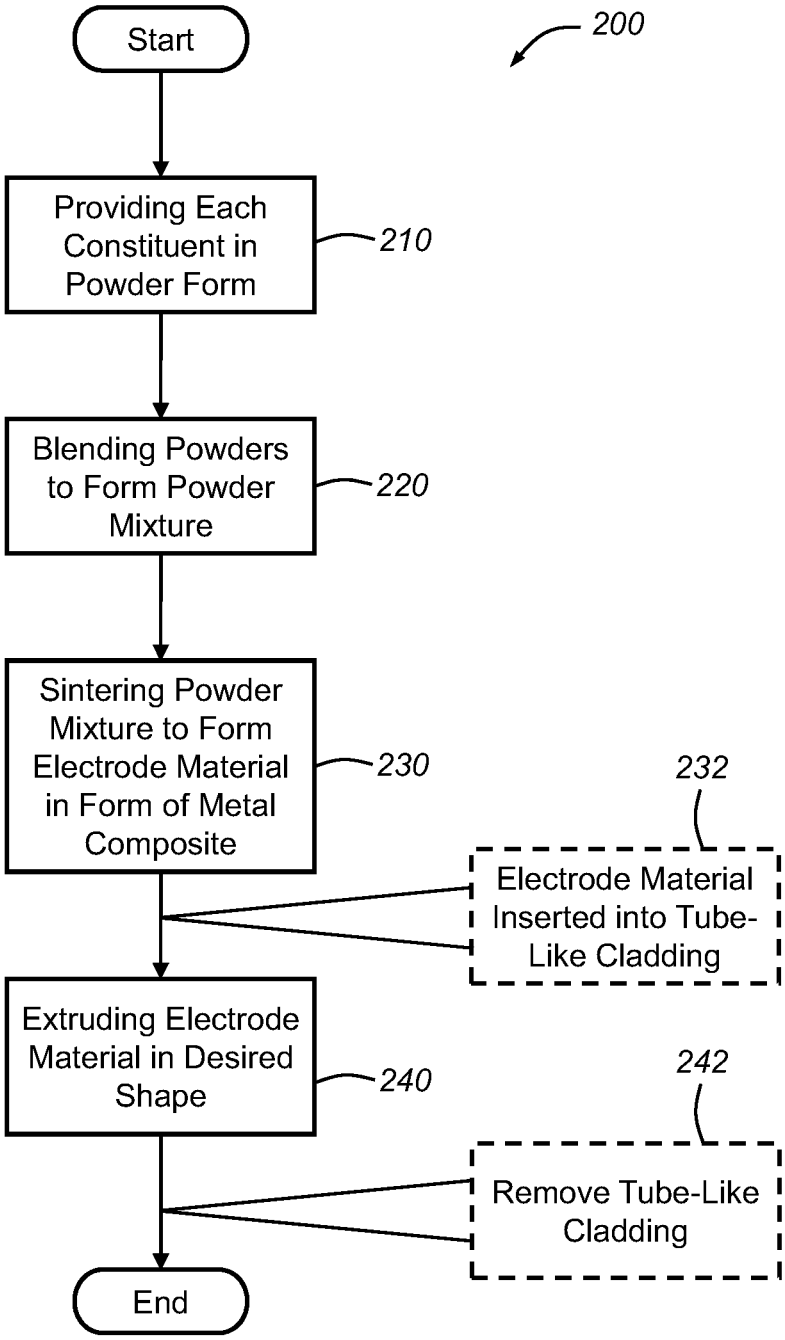
FIG. 7 is a flowchart illustrating an exemplary embodiment of a method for forming a spark plug electrode.

Turning now to FIG. 7, the electrode material can be made using a variety of manufacturing processes, such as powder metallurgical methods. For instance, a process 200 may be used that includes the steps of: providing each of the constituents in powder form where they each have a certain powder or particle size, step 210; blending the powders together to form a powder mixture, step 220; sintering the powder mixture to form the electrode material, step 230; and extruding, drawing or otherwise forming the electrode material into a desired shape, step 240. The process may further include one or more optional steps that provide a cladding or sheath around the electrode material, as will be explained.

In step 210, the matrix and particulate components 102, 104 are provided in powder form and have a particular powder or particle size that may be dependent on a number of factors. According to an exemplary embodiment, the particle size of the matrix component 102 when it is in a powder form is about 1μ to 50μ, inclusive, and the particle size of the particulate component 104 when it is in a powder form is about 1μ to 200μ, inclusive.

Next, step 220 blends the powders from the matrix and particulate components 102, 104 together so that a powder mixture is formed. In one embodiment, the matrix powder constitutes about 2-20 wt % of the overall powder mixture, while the particulate powder constitutes about 80-98 wt % of the overall powder mixture. This mixing step may be performed with or without the addition of heat.

Sintering step 230 may be performed according to a number of different metallurgical embodiments. For instance, the powder mixture (which includes both matrix and particulate components 102, 104) may be sintered in a vacuum or in some type of protected environment at a sintering temperature of about 0.8 $T_{melt}$ of the matrix component 102 in order to form the electrode material in the form of a metal composite. Put differently, the sintering temperature may be set to approximately 0.8 of the melting temperature of the matrix material, which in the case of a pure Pt matrix component is about 1380° C.-1450° C. It is also possible for sintering step 230 to apply pressure in order to introduce some type of porosity control to the electrode material. The amount of pressure applied may depend on the precise composition of the powder mixture and the desired attributes of the electrode material. At this point, the electrode material is preferably a metal composite 100 and exhibits a multi-phase microstructure where the matrix component 102 is distinct or distinguishable from the particulate component 104. The metal composite may have an average particulate component spacing of about 1-20 μm, inclusive, and an average density that is less than or equal to 14.0 g/cm$^3$.

Next, the electrode material may be extruded, drawn or otherwise formed into a desired shape, step 240. If an elongated wire is desired, then the electrode material may be cold extruded to form a fine wire of about 0.3 mm to about 1.5 mm, inclusive, which in turn can be cut or cross-sectioned into individual electrode tips or the like. Of course, other metal forming techniques could be used with step 240 to form the electrode material in parts having different shapes. For example, the electrode material could be swaged, forged, cast or otherwise formed into ingots, bars, rivets, tips, etc. A cold or hot work process will be selected based on, among other potential factors, the weight percentage of the particulate component 104 in the overall metal composite. For a metal composite with a high percentage of the particulate component (e.g., 90 wt % or higher), a hot work process may be good option because of the potential brittleness of the ruthenium-based alloy. However, for a metal composite with a low percentage of the particulate component (e.g., 20 wt %), a cold work process may be a better option.

Figure 8:
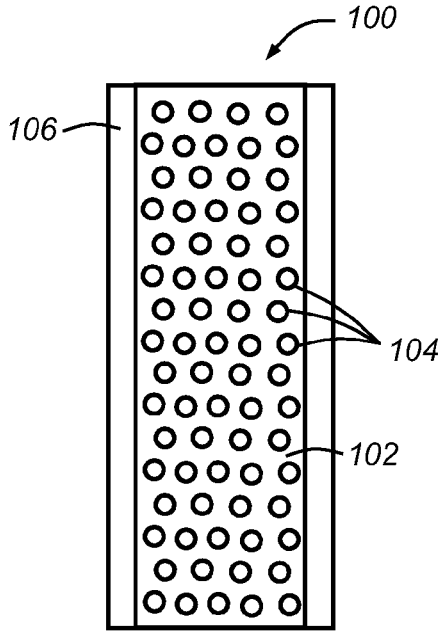
FIG. 8 is a cross-sectional view of the exemplary electrode material of FIG. 6, where the electrode material further includes a cladding structure.

As mentioned above, it is also possible for method 200 to include an optional step where the electrode material is formed with a cladding or sheath made of a different material, so that the combined electrode material and cladding can be co-extruded during step 240. In one embodiment, an additional step 232 is provided where the already sintered electrode material from step 230 is inserted or stuffed into a tube-like cladding structure 106, as illustrated in FIG. 8. The cladding structure 106 may be precious metal-based, copper-based, zinc-based or nickel-based, for example. In the event that cladding structure 106 is precious metal-based, the cladding or sheathing may include pure platinum (Pt), pure palladium (Pd), pure gold (Au), pure silver (Ag) or some alloy thereof. In the example of a copper-based cladding structure, oxygen-free copper (Cu) is an acceptable choice. Zinc-based cladding structures may be used in instances where it is desirable to have a high degree of lubrication during the extrusion process. Other cladding materials are also possible. A cladding structure 106 having an outer diameter of about 0.3 mm-1.5 mm and a cladding wall thickness of less than about 150 μm may be used.

Figure 9:
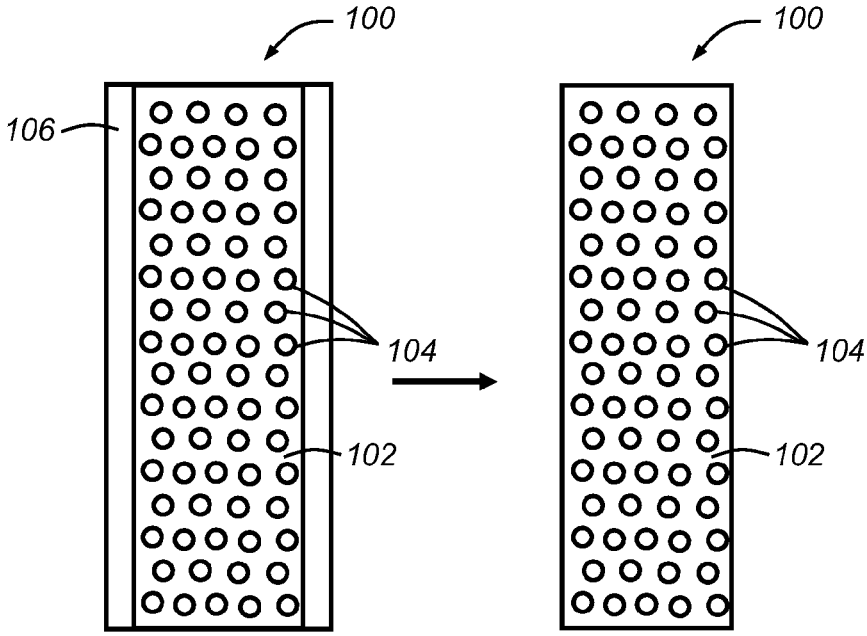
FIG. 9 is a cross-sectional view of the exemplary electrode material of FIG. 8, where the cladding structure is subsequently removed via a chemical etching or other process.

In the exemplary copper-based, zinc-based and nickel-based cladding examples introduced above, once the electrode and cladding materials have been co-extruded, the cladding structure 106 may be removed by chemical etching or some other suitable technique, optional step 242. This process is illustrated in FIG. 9. In these examples, the cladding structure is used to facilitate the extrusion process but is removed thereafter so that the resulting electrode material can be formed into a spark plug electrode without any cladding. In the precious metal-based examples above, the cladding may be left intact after the co-extrusion process; that is, the cladding can be left on the electrode and can act as a thin protective outer layer.

The above-described processes may be used to form the electrode material into various shapes (such as rods, wires, sheets, etc.) that are suitable for further spark plug electrode and/or firing tip manufacturing processes. Other known techniques such as melting and blending the desired amounts of each constituent may be used in addition to or in lieu of those steps mentioned above. The electrode material can be further processed using conventional cutting and grinding techniques that are sometimes difficult to use with other known erosion-resistant electrode materials.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

wherein the center electrode, the ground electrode or both includes an electrode material having a particulate component embedded within a matrix component in the form of a metal composite;

the particulate component includes a ruthenium-based material having at least one precious metal, where ruthenium (Ru) is the single largest constituent of the particulate component on a wt % basis; and the matrix component includes a precious metal, where the precious metal is the single largest constituent of the matrix component on a wt % basis.

2. The spark plug of claim 1, wherein the particulate component includes a ruthenium-based material having a precious metal that is the second largest constituent of the particulate component on a wt % basis, and the precious metal is present in the particulate component from about 0.1 wt % to about 49.9 wt %, inclusive.

3. The spark plug of claim 2, wherein the precious metal is selected from the group consisting of: rhodium (Rh), platinum (Pt), palladium (Pd), iridium (Ir) or gold (Au).

4. The spark plug of claim 2, wherein the particulate component includes rhodium (Rh) from about 0.1 to 15 wt % and ruthenium (Ru) as the balance.

5. The spark plug of claim 1, wherein the particulate component further includes at least one refractory metal selected from the group consisting of: tungsten (W), rhenium (Re), tantalum (Ta), molybdenum (Mo) or niobium (Nb).

6. The spark plug of claim 1, wherein the particulate component further includes at least one rare earth metal selected from the group consisting of: yttrium (Y), hafnium (Hf), scandium (Sc), zirconium (Zr) or lanthanum (La).

7. The spark plug of claim 1, wherein the matrix component includes a platinum-based material where platinum (Pt) is the single largest constituent of the matrix component on a wt % basis.

8. The spark plug of claim 7, wherein the platinum-based material is made from pure platinum (Pt).

9. The spark plug of claim 1, wherein about 2-20 wt % of the metal composite is in the form of the matrix component and about 80-98 wt % of the metal composite is in the form of the particulate component.

10. The spark plug of claim 1, wherein the metal composite has an average particulate component spacing of about 1-20 μm, inclusive.

11. The spark plug of claim 1, wherein the metal composite has an average density that is less than or equal to 14.0 g/cm$^3$.

12. The spark plug of claim 1, wherein the metal composite, after extrusion, has a microstructure with grains of the matrix component that are more elongated or more fiber-like than grains of the particulate component.

13. The spark plug of claim 1, wherein the matrix component makes up about 2-20 wt % of the overall metal composite and includes a platinum-based material made from pure platinum (Pt), and the particulate component makes up about 80-98 wt % of the overall metal composite and includes a ruthenium-based alloy with rhodium (Rh) from about 0.1 to 5 wt % and ruthenium (Ru) as the balance.

14. The spark plug of claim 1, wherein the metal composite is at least partially surrounded by a thin cladding material that includes platinum (Pt).

15. The spark plug of claim 1, wherein the center electrode, the ground electrode or both includes an attached firing tip that is at least partially made from the electrode material.

16. The spark plug of claim 15, wherein the firing tip is a multi-piece rivet that includes a second component attached to the center electrode or the ground electrode, and a first component that is attached to the second component and is at least partially made from the electrode material.

17. The spark plug of claim 1, wherein the center electrode, the ground electrode or both is at least partially made from the electrode material and does not include an attached firing tip.

18. A spark plug electrode, comprising:

an electrode material having a particulate component embedded within a matrix component in the form of a metal composite;

the particulate component includes a ruthenium-based material, where ruthenium (Ru) is the single largest constituent of the particulate component on a wt % basis; and the matrix component includes a precious metal, where the precious metal is the single largest constituent of the matrix component on a wt % basis.

19. A method of forming a spark plug electrode, comprising the steps of:

(a) providing a matrix component and a particulate component in powder form, wherein the matrix component includes at least one precious metal and the particulate component includes ruthenium (Ru);

(b) blending the matrix component and particulate component powders together to form a powder mixture;

(c) sintering the powder mixture to form an electrode material, where the electrode material is in the form of a metal composite with the particulate component embedded or dispersed in the matrix component; and (d) forming the electrode material into a spark plug electrode.

20. The method of claim 19, further comprising the step of:

inserting the electrode material from step (c) into a cladding structure, and co-extruding the electrode material and the cladding structure together.

* * * * *